US005558434A

United States Patent [19]

Hamada et al.

[11] Patent Number: 5,558,434

[45] Date of Patent: Sep. 24, 1996

[54] METHOD FOR PREVENTING ACCUMULATION OF SLUDGE IN A COAL WATER MIXTURE STORAGE TANK

[75] Inventors: Kenjiro Hamada; Akira Masubuchi, both of Kawasaki-ku, Japan

[73] Assignee: NKK Corporation, Tokyo, Japan

[21] Appl. No.: 440,761

[22] Filed: May 15, 1995

[30] Foreign Application Priority Data

Oct. 12, 1994 [JP] Japan ..... 6-245958

[51] Int. Cl.[6] ..... B01F 5/04; B01F 15/02; B65D 90/00

[52] U.S. Cl. ..... 366/137; 366/169.1

[58] Field of Search ..... 366/101–104, 366/106, 107, 136, 137, 159.1, 167.1, 167.2, 168.1–169.2, 170.3, 172.1, 182.3; 210/194, 197, 805

[56] References Cited

U.S. PATENT DOCUMENTS

| | | | |
|---|---|---|---|
| 1,135,080 | 4/1915 | Vandercook | 210/194 |
| 1,156,946 | 10/1915 | Vandercook | 366/137 |
| 2,559,518 | 7/1951 | Smith | 366/170.3 X |
| 4,089,507 | 5/1978 | Arai et al. | 366/172.1 X |
| 4,367,048 | 1/1983 | Morita | 366/137 |

FOREIGN PATENT DOCUMENTS

| | | | |
|---|---|---|---|
| 53-21415 | 2/1978 | Japan | 366/136 |
| 63-97219 | 4/1988 | Japan | 366/137 |
| 1-100795 | 7/1989 | Japan . | |

*Primary Examiner*—Charles E. Cooley
*Attorney, Agent, or Firm*—Frishauf, Holtz, Goodman, Langer & Chick, P.C.

[57] ABSTRACT

A method for preventing accumulation of sludge in a coal water mixture storage tank. The method involves:

preparing a coal and water mixture storage tank having a circulation pump for taking a stored liquid out of the storage tank, a liquid conducting pipe vertically standing inside of the storage tank for conducting the stored liquid discharged from the circulation pump to a bottom of the storage tank, one or more nozzles for jetting the stored liquid out of the liquid conducting pipe toward a radial direction of the storage tank and provision for rotating the liquid conducting pipe having an axis at a center of the storage tank;

determining a zone width r(m) of a stirring zone of one of the nozzles, using a formula of:

$$r \leqq Q/(140 \times A^{0.5})$$

where, A is a sectional area ($m^2$) of a nozzle opening and Q is a flow amount of the stored liquid per one nozzle ($m^3/h$);

determining a location of each of the nozzles dependent on the zone width; and jetting the stored liquid from the one or more nozzles in the radial direction of the storage tank while rotating the liquid conducting pipe.

10 Claims, 7 Drawing Sheets

METHOD FOR PREVENTING ACCUMULATION OF SLUDGE IN A COAL WATER MIXTURE STORAGE TANK

BACKGROUND OF THE INVENTION

1. Field of the Invention

The present invention relates to a method for preventing accumulation of sludge made of powdered coal on a bottom of a coal water mixture (CWM) storage tank.

2. Description of Related Art

When CMW is stored in a storage tank, coal particles settle due to a difference in specific gravity and finally make a layer of sludge on a bottom of the storage tank. In this specification, CMW means a coal water mixture which is liquid made by mixing powdered coal and water.

As the settlement of the sludge advances with passage of time, component ratios become ununiform dependent on a liquid depth, and thereby the sludge is accumulates on the tank bottom. When the settled and accumulated sludge becomes lumpy, not only do the pipes of piping get clogged but also the effective storage capacity of the storage tank is reduced as the lumping occurs on full area and the lumps accumulate. Further, it is necessary to carry out a large scale cleaning operation when inspecting the tank by opening it, which results unfavorable effects including a very big rise in maintenance costs.

There is an example where in a CWM storage tank sludge accumulated 1–2 meters deep for one year of storage period.

The following shows representative physical features of CWM:

| | |
|---|---|
| Components: | |
| Water | about 30 wt.% |
| Coal (powdered coal) | about 70 wt.% |
| Additives | about 0.5 wt.% |
| Coal particle size: | |
| ≦ 500 μm | 99% |
| ≦ 150 μm | 94% |
| Apparent viscosity: | 900 ± 300 CP on condition that a temperature is 25° C. and a shearing speed is 100 per sec. |
| Specific gravity: | 1.25 |
| Calorific value: | 5 000 kcal/kg |

An example, of a prior art apparatus for preventing accumulation of sludge is disclosed in a Japanese Unexamined Utility Model Publication No. 1-100795. FIG. 8 shows a constitution of this apparatus.

As shown in FIG. 8, referential number 1 denotes a storage tank, 2 a stored liquid, 3 a side wall, 4 a bottom, 7 a liquid suction pipe, 9 a valve, 10 a rotary joint, 11 a circulator pump and 12 a liquid feed pipe. Further, referential number 19 denotes a descending pipe, 21, 22, 23, 24 jet pipes constituting nozzles, 31 a liquid feed branch pipe, 32 a rail, and 33 a travel device. Symbol mark "S" denotes sludge.

The rail 82 is circularly placed on an inside of a cover roof of the storage tank 1, and the travel device 33 equipped with a drive source is hung, being engaged with the rail. The liquid feed branch pipe 31 is horizontally extended near the roof cover and the two descending pipes 19 vertically are branched from the branch pipe 31, provided with the nozzles 21, 22, 23, 24 on lower ends of the descending pipes. The branch pipe 31 and the descending pipes are held by the rail 32.

When the travel device 33 travels during the stored liquid 2 being sent by the circulation pump 11 of the prior art apparatus thus constituted, the descending pipe 19 rotate around a center axis of the storage tank t while the stored liquid 2 is being jetted out of the right and left nozzles 21, 22, 23, 24. Then, sludge "S" which is inclined to settle on the bottom 4 of the storage tank 1 is stirred by the stored liquid 2 jetted out of the nozzles 21, 22, 23, 24 and the accumulation of the sludge is prevented.

In case of the prior art apparatus shown in FIG. 8, however, special consideration was not given to technical study of the flow of the stored liquid jetted out of the nozzles. Consequently, stirring produced by the jet flow of the stored liquid was not sufficiently operated, and there was a disadvantage in that the apparatus was ineffective in preventing accumulation of sludge since it was unable to effectively utilize the jet flow.

SUMMARY OF THE INVENTION

The object of the present invention is to provide a method for effectively preventing accumulation of sludge in a CWM storage tank by forming a stirring zone by means of a circulation jet flow of stored liquid which is led by an empirical formula representing the jetting condition of a nozzle.

To attain the object, the present invention provides a method for preventing accumulation of sludge in a coal water mixture storage tank, comprising the steps of:

preparing a coal water mixture storage tank having a circulation pump for taking a stored liquid out of the storage tank, a liquid conducting pipe vertically standing inside of the storage tank for conducting the stored liquid discharged from the circulation pump to a bottom of the storage tank, one or more nozzles for jetting the stored liquid out or the liquid conducting pipe toward a radial direction of the storage tank and a rotary means for rotating the liquid conducting pipe having an axis at a center of the storage tank;

determining a zone width r(m) of a stirring zone of one of the nozzles, using a formula of:

$$r \leqq Q/(140 \times A^{0.5})$$

where, A is a sectional area of a nozzle opening ($m^2$) and Q is a flow amount of said stored liquid per one nozzle ($m^3/h$);

determing a location of each of the nozzles dependent on the zone width; and jetting the stored liquid from the one or more nozzles in the radial direction of the storage tank while rotating the liquid conducting pipe.

DETAILED DESCRIPTION OF PREFERRED EMBODIMENT

Figure 1:
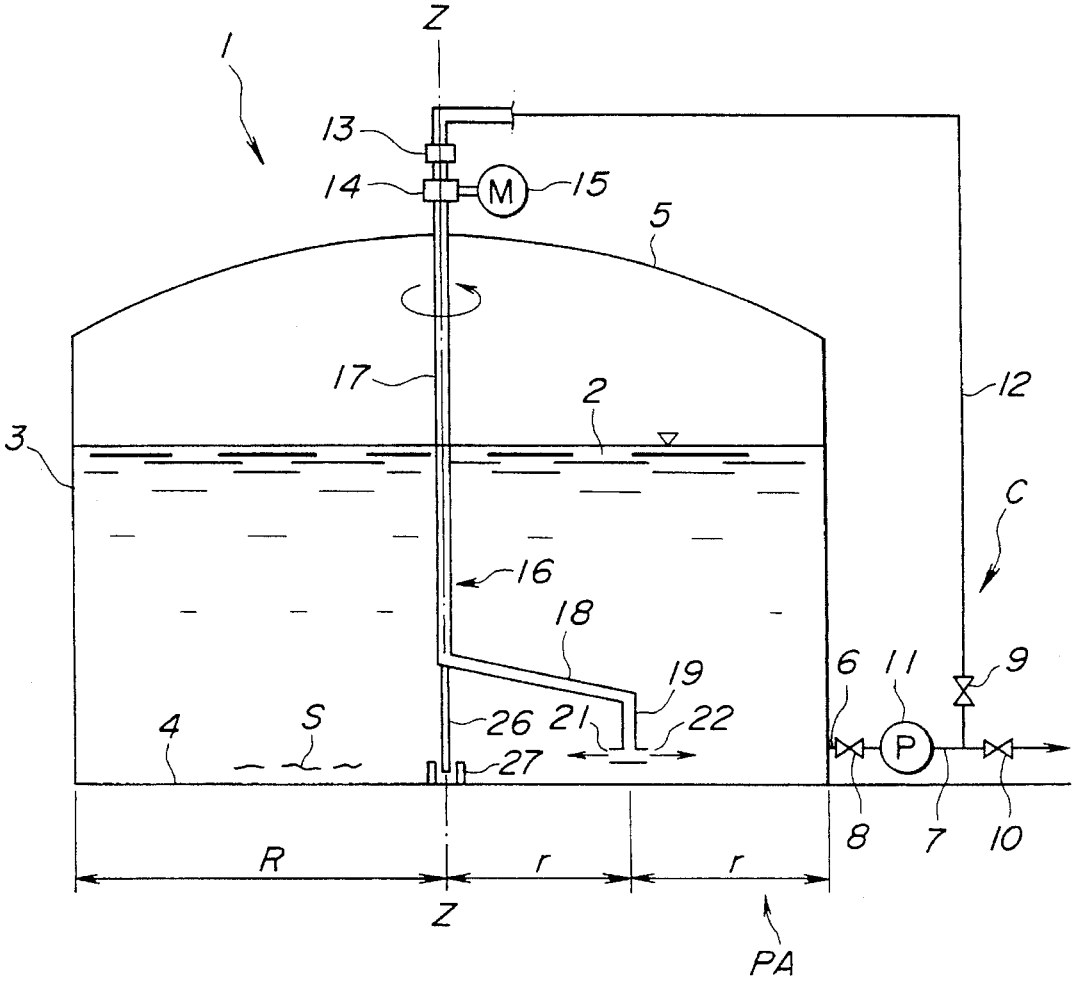
FIG. 1 is a view of an embodiment 1 of an a apparatus for carrying out a method of the present invention.

In a method for preventing accumulation of sludge in a CWM storage tank according to the present invention, a stored liquid fed from the CWM storage tank by a pump is supplied to nozzles via a liquid conducting pipe, the stored liquid is jetted through the nozzles toward an inside or an outside of a radial direction of the CWM storage tank, and a vicinity of a bottom of the CWM storage tank is stirred by the jetting, and thereby the accumulation of sludge is prevented.

At the same time, the liquid conducting pipe is rotated by a rotational means having an axis at a center of the storage tank and annular or circular stirring zones are formed where stirring is operated by the jet flow through each of the nozzles. It should be noted, however, that the operation of this apparatus is enough at every predetermined time interval.

In order to carry out effective prevention of the sludge accumulation by the method described above, the zone width r [m] of a stirring zone per one nozzle is determined is by a formula given below.

$$r \leqq Q/(140 \cdot A^{0.5}) \quad (1)$$

where A is a sectional area of a nozzle opening ($m^2$) and Q is a flow amount of the stored liquid per one nozzle [$m^3$/h].

Further, the zone width r (m) of the stirring zone per one nozzle is any one of values(distances) as defined below:

a. A distance(m) from a leg part of the liquid conducting pipe communicated with the nozzle to the storage tank side wall as for one which is the nearest to the storage tank side wall among the nozzles facing the outside of the radial direction of the storage tank;

b. A distance (m) from a leg part of the liquid conducting pipe communicated with the nozzle to the center axis of the storage tank as for one which is the nearest to the center axis among the nozzles facing the center side of the radial direction of the storage tank in the case where there are no nozzles on the center axis of the storage tank; and c. A half of a distance (m) between orbits of leg parts of adjacent liquid conducting pipes as for the nozzles communicated with the leg parts of the liquid conducting pipes which have orbits adjacent to one another and are provided opposed to one another for stirring a part among the orbits in the case where there are the leg parts of a plurality of the liquid conducting pipes having different orbital radiuses.

Further, the formula (1) is obtained by the inventors in accordance with the following:

When the stored liquid is jetted out of the nozzle, a relation between a flow speed $U_0$ (m/sec) at the nozzle opening and a flow speed $U_m$ (m/sec) at a point located on a jet flow axis away from the nozzle by a distance X(m) can be approximated each other by a formula (2) given below:

$$U_m = U_0 D_0/(K \cdot X) \quad (2)$$

wherein, K is a constant(K=0.22) experimentally obtained and $D_0$ (m) is a diameter of the nozzle opening.

On the other hand, it was found by an experiment that the flow speed $U_m$ of 0.2 m/sec or more was needed in order to effectively prevent the accumulation of sludge.

Figure 4:
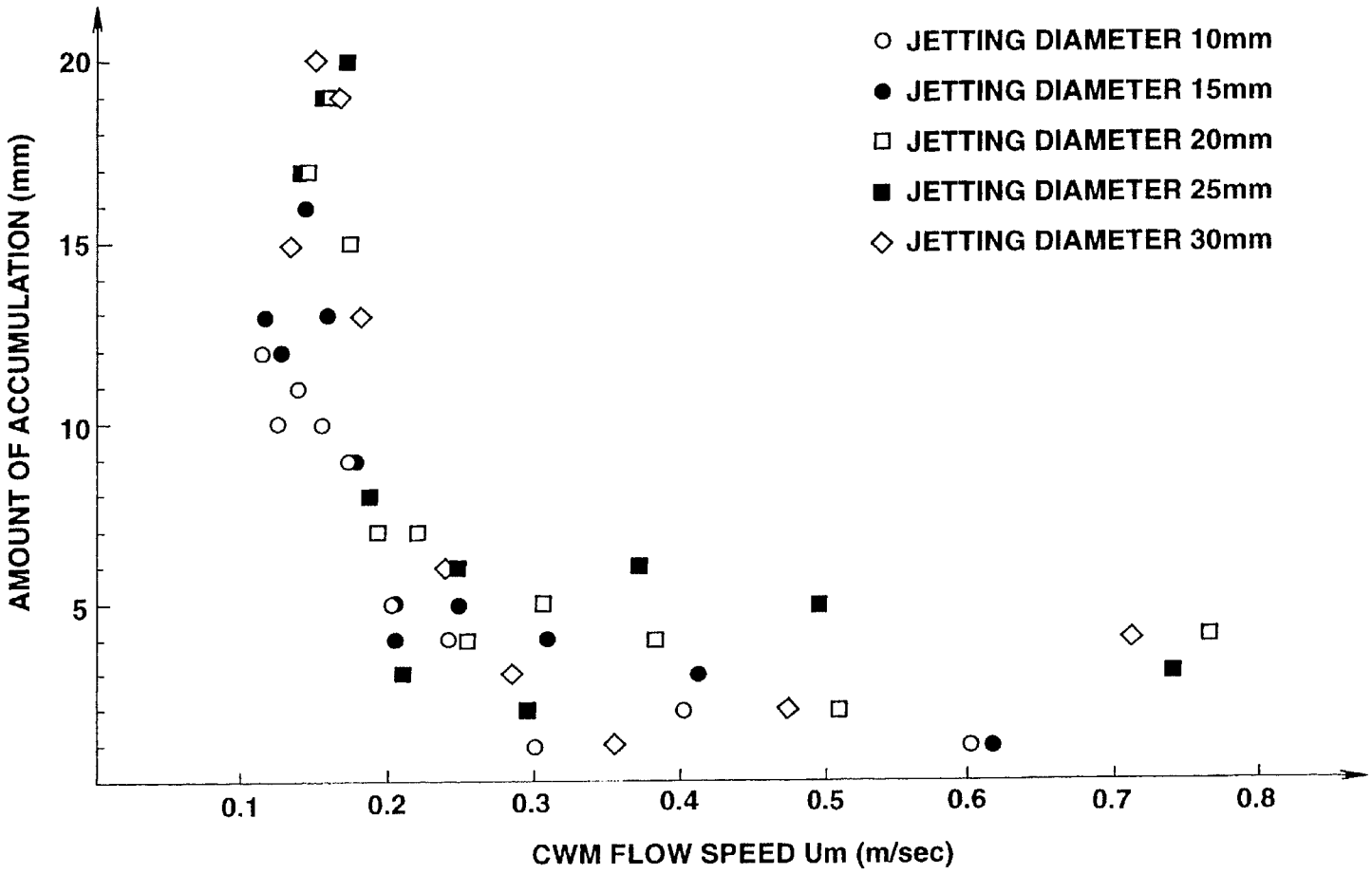
FIG. 4 is a plot view showing a relation between an amount of accumulated sludge and a flow speed at the embodiment 1 of the present invention.

FIG. 4 shows a relation between an amount of accumulation and a flow speed measured by using an experimental storage tank. In the experiment, the diameters of the nozzles were varied among five different values, 10 mm, 15 mm, 20 mm, 25 mm and 30 mm. The abscissa indicates a flow rate $U_m$ and the ordinate indicates the amount (mm) of an accumulation increase after two weeks. For each diameter, jetting of CWM was carried out under the same operational conditions given below:

Operation interval: Once/a day

Operation time: 30 minutes/once

As shown in FIG. 4, there is a tendency wherein the amount of accumulation increase declines and converges when the flow speed is 0.2 m/sec or more, irrespective of the variation of the nozzle diameters.

Thus, the range for carrying out effective stirring is represented by the following formula with a distance X from the nozzle:

$$U_0 \cdot D_0/(K \cdot X) \geqq 0.2 \quad (3)$$

When the formula (3) is changed in terms of the distance X from the nozzle, another formula is obtained given as below:

$$X \leqq 5 \cdot U_0 \cdot D_0/K \quad (4)$$

If each element of the formula (4) is substituted by the following:

$$U_0\text{: } Q/(3600 \cdot A)$$

$$D_0 = (4 \cdot A/\pi)^{0.5}$$

$$K = 0.22$$

and then, by discarding those below a decimal point, the following is obtained:

$$X \leqq Q/(140 \cdot A^{0.5}) \quad (5)$$

At the formula (5), a distance X from the nozzle corresponds to a zone width (r) wherein stirring is effectively operated by one nozzle which rotates in the CWM storage tank.

Now preferred embodiments of the method of present invention will be described.

Embodiment 1

FIG. 1 illustrates an apparatus of the embodiment 1 where the method of the present invention is carried out. The basic constitution of the apparatus is similar to that of the mentioned prior art apparatus. However, since some parts use different names from those of the prior art apparatus and the constitution is different in some parts, it will be described somewhat in detail.

In FIG. 1, referential number 1 denotes a storage tank and 2 a stored CWM liquid. The stored liquid 2 is stored in the storage tank 1 with an amount reaching a liquid surface shown in the Figure. Referential number 3 denotes a cylindrically formed side wall in the storage tank 1, 4 a tank bottom add 5 a roof. Symbol mark "R" denotes a radius of the storage tank 1 and "S" denotes sludge made of powdered coal settled on the tank bottom. Further, the storage tank 1 of the embodiment 1 has a radius R of 10 meters and a volume of 5000 $m^3$.

Referential number 6 denotes a discharge port installed at a bottom of the side wall 3, 7 a discharge pipe, 8, 9, 10 control valves, 11 a circulation pump and 12 a supply pipe. The supply pipe 12 is connected to an outlet side of the circulation pump 11 through the control valve 9. Referential number 13 denotes a rotary joint disposed on an upper part of the roof 5, 14 a rotating device and 15 a motor. To a fixed side of the rotatary joint 13 one end of the supply pipe 12 is air-tightly connected so as to prevent leakage of the stored liquid 2 to be introduced. The motor 15 is for driving the rotating device 14.

Referential number 16 is a liquid conducting pipe installed within the storage tank 1 and connected to the rotary joint 13. The liquid conducting pipe 16 comprises a shaft part 17 disposed on a center axis Z-Z of the storage tank 1, an arm part 18 slightly incliningly extended in the radial direction R from an intermediate part of the shaft part 17 in the vicinity of the tank bottom 4 and a leg part 19 at a tip of the arm part 18. The length of the arm part 18 of the embodiment 1 corresponds to a zone width (r) calculated by the empirical formula (1) described above. Further, the leg part 19 is made of a reverse T-shaped pipe and nozzles 21 and 22 on both sides are opened in the radial direction.

Referential number 26 denotes a connecting shaft of a lower end of the shaft part 17 and 27 denotes a bearing installed on the tank bottom 4. The liquid conducting pipe 16 is supported by the rotary joint 13 at an upper part of the liquid conducting pipe 16 and the bearing 27 at a lower part thereof and is rotated by having a tank shaft Z-Z as a center axis. A circulation circuit C for flowing the stored liquid 2 back into the storage tank 1 by the circulation pump 11 is formed. The circulation circuit comprises an inner circuit of the liquid conducting pipe 16 and an outside circuit which have the discharge pipe 7 and the supply pipe 12. Further, a sludge accumulation prevention area, P A is formed on the tank bottom, having a stirring zone where the sludge accumulation is prevented by utilizing the stored liquid 2 jetted out of the nozzles 21 and 22. Stirring movement of the stored liquid 2 with the nozzles is explained later.

Figure 2:
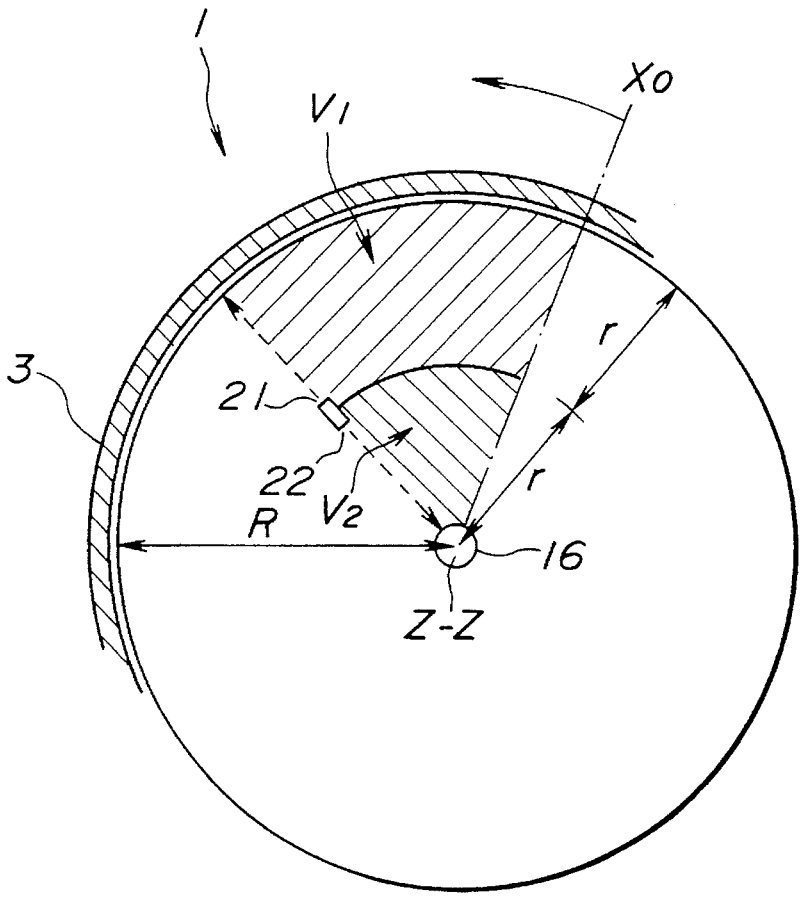
FIG. 2 is a view of a jet flow movement of the embodiment 1 of the present invention.
Figure 3:
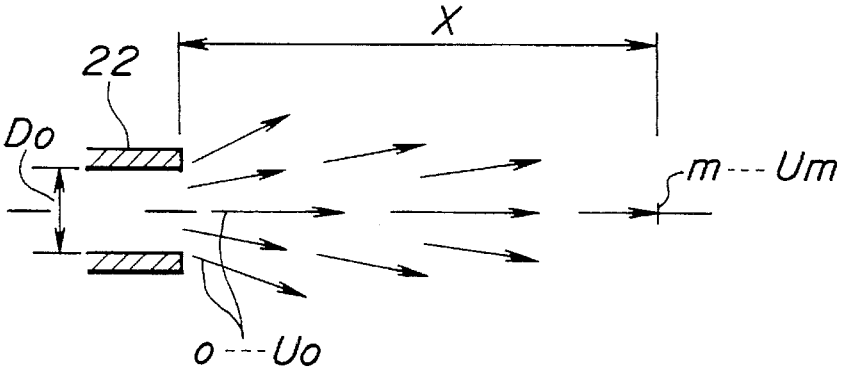
FIG. 3 is a view of a stirring operation of a nozzle of the present invention.

The operation of the embodiment 1 which carries out the method of the present invention will be described with reference to the FIGS. 2 and 3.

It is assumed that a specified amount of the stored liquid 2 is stored in the storage tank 1 in advance of the operation as shown in FIG. 1.

When the stirring operation is started in the sludge accumulation prevention area, P A, the valves 8 and 9 of the control vales 8, 9, 10 are opened. Then, the circulation pump 11 is driven and the circulation circuit C for circulating the stored liquid 2 is communicated. By the driving of the circulation pump 11, the stored liquid 2 on the bottom of the storage tank 1 is pumped out of the discharge port 6 and pumped upward through the supply pipe 12 via the control valve 9.

The pumped-up stored liquid 2 is supplied to the center on the upper part of the roof 5 of the storage tank 1 and sent into the liquid conducting pipe 16 through the rotary joint 13. Further, the stored liquid 2 sent into the liquid conducting pipe 16 is passed through the arm parts 18 and leg parts 19, and then, the stored liquid 2 is jetted out of both right and left nozzles 21 and 22 in centrifugal and centripetal directions along the radius R inside the bottom of the storage tank 1.

On the other hand, power is supplied to the motor 15 at the same time when the circulation pump 11 is driven. By having the tank shaft Z-Z as a center axis, the liquid conducting pipe 16 begins to be rotated, for example, anticlockwise from a reference position $X_0$ as shown by an arrow in FIG. 2. The leg part 19 which is constructed integrally with the liquid conducting pipe 16 via the arm part 18 is rotated along the circular locus of the radius (r) at a predetermined speed. Then, with the circular locus along which the leg part 19 is rotated, two stirring zones V1 and V2 with zone w dth (r) are formed, the zone width corresponding to an effective length of the flow jetted out of the nozzles 21 and 22 indicated by slant lines.

The two stirring zones V1 and V2 are respectively formed annularly and circularly and brought to the vicinity of the bottom 4 of the tank 1 as the liquid conducting pipe 16 is rotated. Thus, the stirring zones cover the full area of the tank bottom. Consequently, powdered coal which settls and begins to accumulate in the stirring zones V1 and V2 on the bottom 4 is stirred by the jet flow from the nozzeles in the sludge accumulation preventing area P A which is communicated to the circulation circuit C. In this way, the accumulation of sludge S can be prevented by the two appropriate jet flows in opposing directions effectively and without any loss.

According to the results gained by calculation of the formula (1) in relation to the storage tank having the structure shown in FIG. 1, the specification of the nozzles 21 and 22 and the stirring zones in the sludge accumulation preventing area P A is given as shown below:

| | |
|---|---|
| Diameters of the nozzles 21,22 | $d_0 = 0.035$ m |
| Sectional areas of the nozzles 21, 22 | $A = 9.62 \times 10^{-4}$ m$^2$ |
| Discharge amount per one nozzle | $Q = 60$ m$^3$/h |
| Widths of the stirring zones V1, V2 | r = 5 m |

Figure 5:
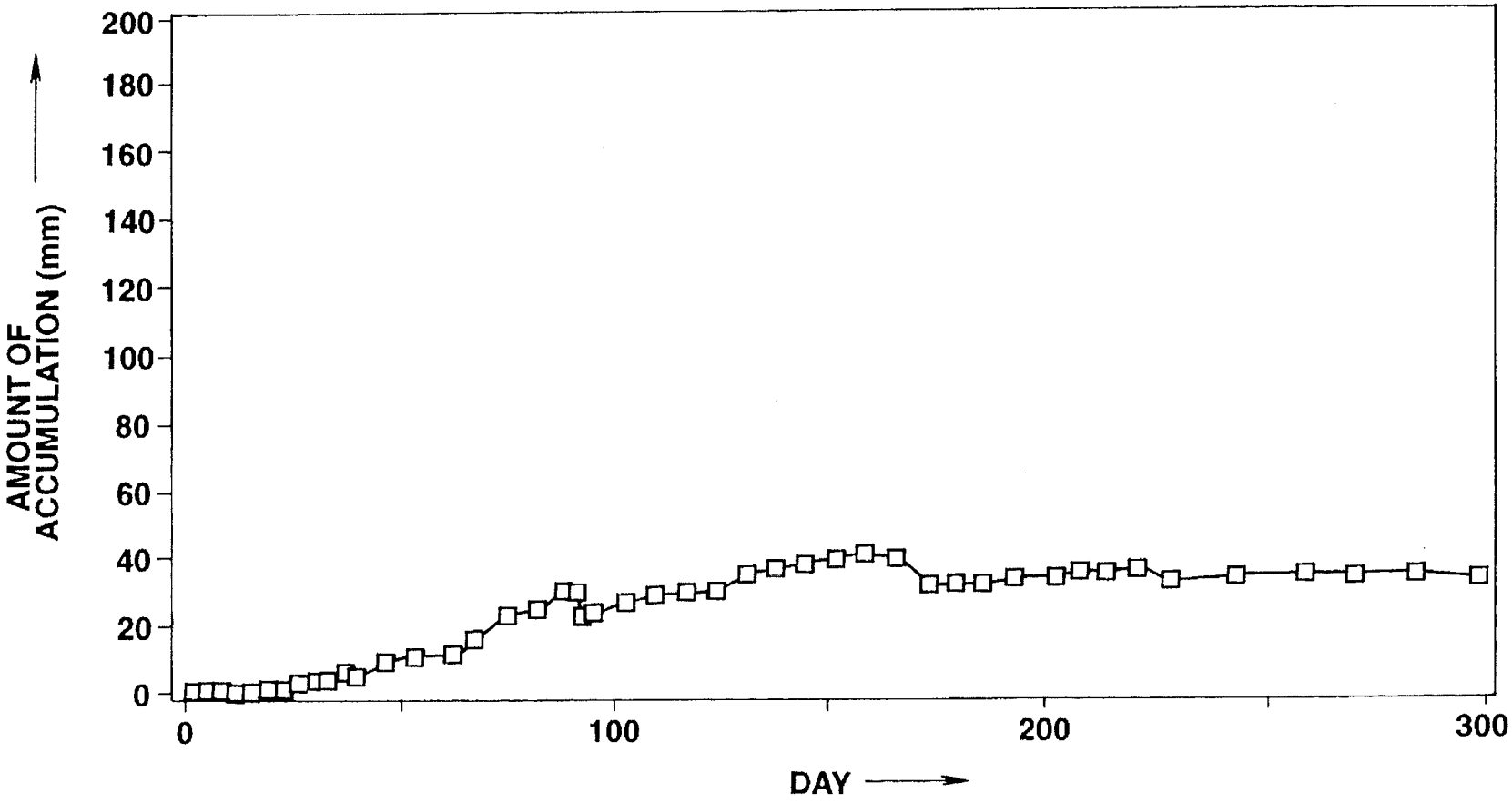
FIG. 5 is a graph showing the amount of the accumulated sludge in the embodiment 1 of the present invention.

FIG. 5 is a graph showing the changes of the actual accumulated amounts.

It shows the values of the amounts of sludge S accumulated in the storage tank 1 of the embodiment 1 actually measured during a period of about 300 days (abscissa). The values of accumulated amounts were obtained by measuring a differences from the initial value with weighed tapes hung through case pipes installed on nine points of the roofing 5. As shown by the graph in FIG. 5, the average accumulated amount on nine points is only 40 mm for the period of 300 days. It is found that the accumulation is very small.

Embodiments 2 and 3

Figure 6:
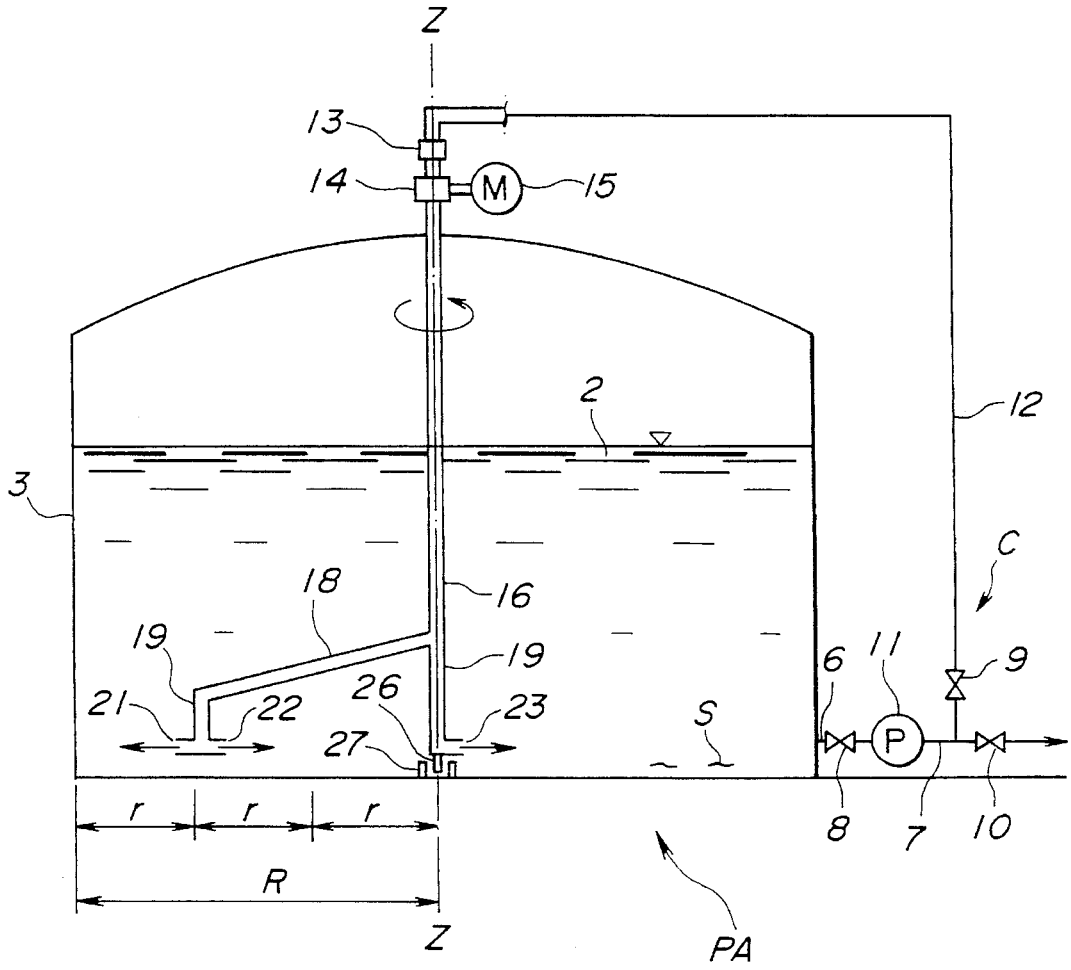
FIG. 6 is a view of an embodiment 2 of an apparatus for carrying out a method of the present invention.
Figure 7:
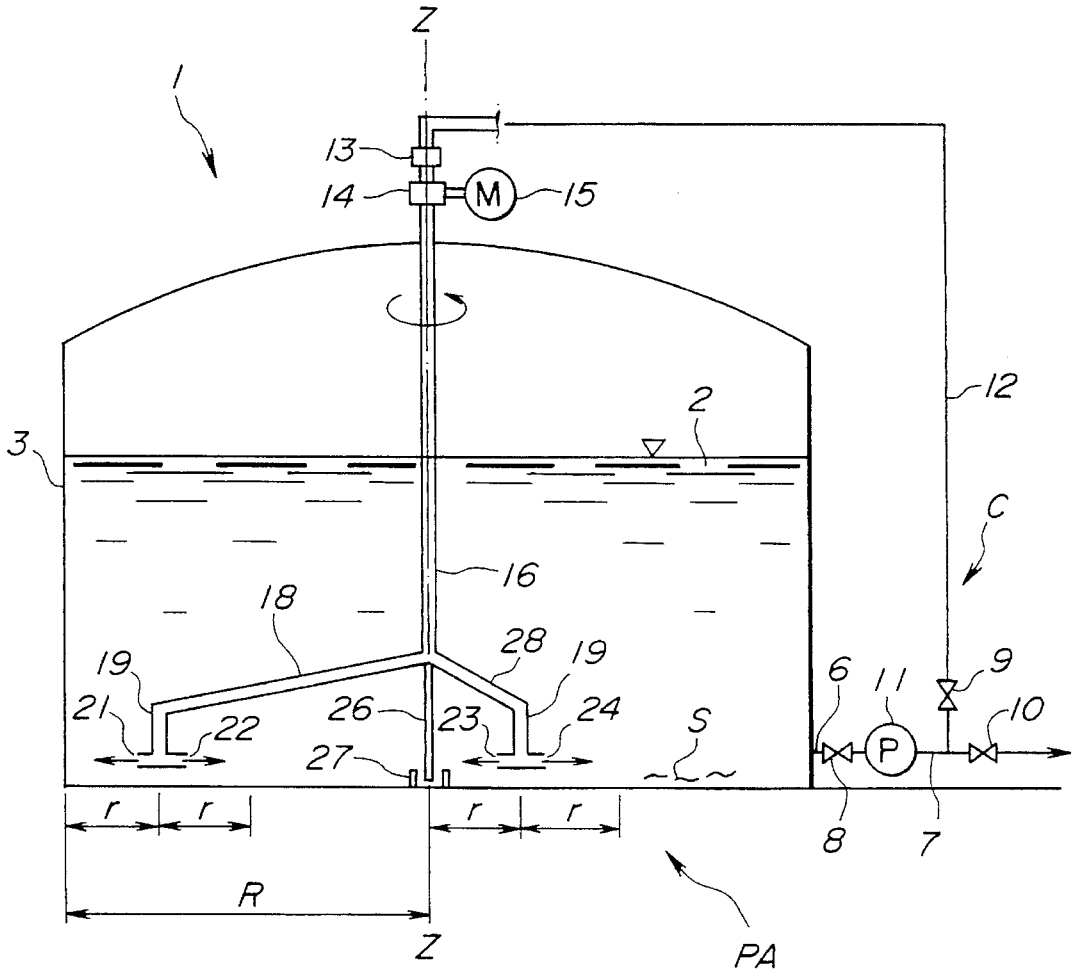
FIG. 7 is a view of an embodiment 3 of an apparatus for carrying out a method of the present invention.
Figure 8:
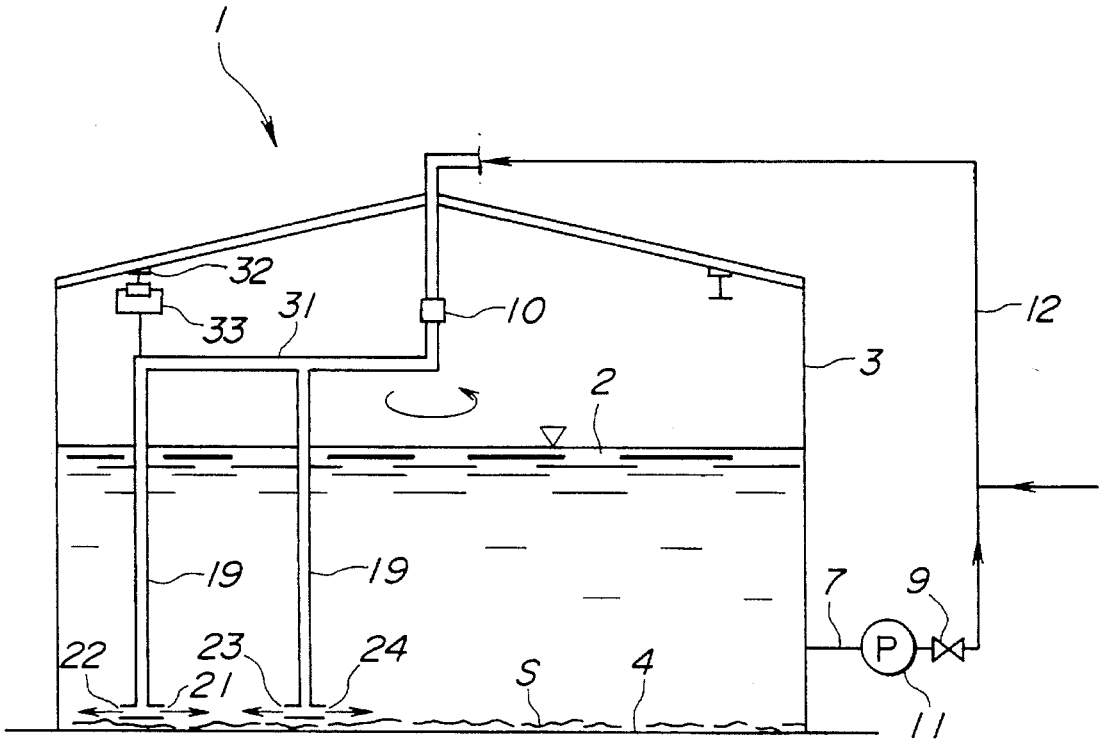
FIG.8 (PRIOR ART)
FIG. 8 is a view of a prior art apparatus.

FIG. 6 and FIG. 7 are views illustrating constitutions of embodiments 2 and 3 of apparatuses for carrying out methods of the present invention.

The storage tanks 1 of both of these embodiments are larger than that of the embodiment 1, having radiuses of 18 meters and 24 meters and capacities of 24000 m$^3$ and 50000 m$^3$ respectively. In these embodiments 2 and 3, in response to the sizes of the storage tanks 1 the arm parts 18 of the liquid conducting pipes 16 are formed longer than that of the embodiment 1 and extended to the side walls 3.

Further, a connecting shaft 26 of the embodiment 2 shown in FIG. 6 is formed extremely short and an L-shaped jet pipe is formed provided with a nozzle 23 on a lower end of the liquid conducting pipe 16. The nozzle 23 is opened to a side opposed to nozzles 21 and 22. On the other hand, in the embodiment 3 shown in FIG. 7, another branched and short arm part 28 as similar to the arm part 18 is provided. The short arm part 28 is disposed on the radius R line of a direction opposed to the arm part 18, and to a leg part 19 a reverse T-shaped jet pipe provided with nozzles 23 and 24 is connected.

For both of the embodiments 2 and 3, zone widths (r) are set at 6 meters calculated by the empirical formula (1). With the zone widths set at 6 meters, the full area of the tank bottoms 4 are covered with three sets of stirring zones V1, V2 and V3 and four sets of V1, V2, V3 and V4 respectively (not shown), and thereby the accumulation of sludge S can be effectively prevented.

Further, in the embodiments 2 and 3 described above, the case where the increased nozzles were placed on the radius of the opposing side are explained. However, it is possible to dispose all the nozzles on one and the same radius. The case that the jet pipe is a reverse T-shaped or L-shaped is explained, but a jet pipe which is bent in an S shape on a horizontal plane can also be used. The form of the arm part and the arrangements and positions of the members constituting the accumulation preventing apparatus are not necessarily limited to those of the embodiments.

Thus, according to the method of the present invention, the zone width stirred by the nozzles is obtained by the mentioned empirical formula and based on the obtained zone width, the arrangement of the nozzles are determined. The sludge which settles and begins to accumulate on the tank bottom is effectively stirred by the jet flows coming out through the nozzles and is floated in the stored liquid. In this way, the accumulation of sludge in the CWM storage tank can be surely prevented.

What is claimed is:

1. A method for preventing accumulation of sludge in a coal water mixture storage tank, comprising the steps of:

preparing a coal water mixture storage tank having a circulation pump for taking a stored liquid out of sad storage tank, a liquid conducting pipe vertically standing inside of said storage tank for conducting said stored liquid discharged from said circulation pump to a bottom of said storage tank, a nozzle for jetting the stored liquid out of said liquid conducting pipe toward a radial direction of said storage tank and a rotary means for rotating the liquid conducting pipe having an axis at a center of said storage tank;

determining a zone width r(m) of a stirring zone of said nozzle, using a formula of:

$$r \leqq Q/(140 \times A^{0.5})$$

where, A is a sectional area of a nozzle opening ($m^2$) and Q is a flow amount of said stored liquid per one nozzle ($m^3/h$);

determing a location of said nozzle dependent on said zone width; and jetting said stored liquid from said nozzle in said radial direction of said storage tank while rotating said liquid conducting pipe.

2. The method of claim 1, wherein two or more nozzles are used, and comprising determining the location of each of said nozzles dependent on said zone width; and jetting said stored liquid from one or more of said nozzles in said radial direction of said storage tank while rotating said liquid conducting pipe.

3. The method of claim 2, wherein said stored liquid is jetted out of one or more nozzles so arranged as to cover the total distance, in the radial direction, to a wall of said storage tank with said stirring zones of said respective nozzles.

4. The method of claim 3, wherein said liquid conducting pipe has an arm part branched therefrom and a nozzle placed at the tip of said arm part, said method further comprising jetting said stored liquid out of the nozzle placed at the tip of the arm part branched from said liquid conducting pipe, toward a side wall of said storage tank.

5. The method of claim 3, wherein said liquid conducting pipe has an arm part branched therefrom and a nozzle placed at the tip of said arm part, said method further comprising jetting said stored liquid out of the nozzle placed at the tip of the arm part branched from said liquid conducting pipe, toward a center of said storage tank.

6. The method of claim 3, wherein a nozzle is placed on a lower part of said liquid conducting pipe vertically standing on a center of the storage tank, and said method further comprises jetting said stored liquid out of the nozzle placed on a lower part of said liquid conducting pipe, in said radial direction.

7. The method of claim 1, wherein said stored liquid is jetted out of said nozzle which nozzle is arranged to cover the total distance in the radial direction to a wall of said storage tank with said stirring zone of said nozzle.

8. The method of claim 1, wherein said liquid conducting pipe has an arm part branched therefrom and a nozzle placed at the tip of said arm part, said method further comprising jetting said stored liquid out of the nozzle placed at the tip of the arm part branched from said liquid conducting pipe, toward a side wall of said storage tank.

9. The method of claim 1, wherein said liquid conducting pipe has an arm part branched therefrom and a nozzle placed at the tip of said arm part, said method further comprising jetting said stored liquid out of the nozzle placed at the tip of the arm part branched from said liquid conducting pipe, toward a center of said storage tank.

10. The method of claim 1, wherein a nozzle is placed on a lower part of said liquid conducting pipe vertically standing on a center of the storage tank, and said method further comprises jetting said stored liquid out of the nozzle placed on a lower part of said liquid conducting pipe, in said radial direction.

* * * * *